US008534469B2

(12) United States Patent
Northrup, Jr. et al.

(10) Patent No.: US 8,534,469 B2
(45) Date of Patent: Sep. 17, 2013

(54) INVENTORY DISPLAY LOCK

(75) Inventors: Robert Louis Northrup, Jr., Machesney Park, IL (US); Patrick J. Barkdoll, Pecatonica, IL (US); Thomas E. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 112 days.

(21) Appl. No.: 13/286,361

(22) Filed: Nov. 1, 2011

(65) Prior Publication Data

US 2013/0105418 A1 May 2, 2013

(51) Int. Cl.
*E05B 73/00* (2006.01)

(52) U.S. Cl.
USPC ..... 211/7; 211/57.1; 211/59.1

(58) Field of Classification Search
CPC ... A47F 5/0861; A47F 5/0823; A47F 5/0869; A47F 5/0876; A47F 5/0807; A47F 5/0815; E05B 69/006
USPC ..... 211/7, 8, 57.1, 59.1; 248/220.21, 248/220.22, 220.31, 220.41, 222.51; 70/57.1, 70/57, 58, 14, 62, 34, 46, 52
See application file for complete search history.

(56) References Cited

U.S. PATENT DOCUMENTS

| | | | | |
|---|---|---|---|---|
| 712,765 | A | 11/1902 | Cole | |
| 892,407 | A | 7/1908 | Courtney et al. | |
| 1,164,613 | A | 12/1915 | Jewell | |
| 1,755,927 | A | 4/1930 | Levinsohn | |
| 2,372,683 | A | 4/1945 | Robertson | |
| 3,622,011 | A | 11/1971 | Snow | |
| 3,906,592 | A | 9/1975 | Sakasegawa et al. | |
| 4,027,798 | A | 6/1977 | Swaim | |
| 4,063,646 | A | 12/1977 | Stahl, Jr. | |
| 4,223,542 | A * | 9/1980 | Basseches | 70/58 |
| 4,289,242 | A * | 9/1981 | Kenyon | 211/4 |
| 4,394,909 | A | 7/1983 | Valiulis et al. | |
| 4,510,649 | A | 4/1985 | Yudis et al. | |
| 4,756,504 | A | 7/1988 | Chamberlain | |
| 4,850,557 | A | 7/1989 | Valiulis | |
| 5,009,334 | A | 4/1991 | Bodkins | |
| 5,027,622 | A * | 7/1991 | Hatch et al. | 70/14 |
| 5,075,932 | A | 12/1991 | Hunt et al. | |
| 5,135,188 | A | 8/1992 | Anderson et al. | |
| 5,259,220 | A * | 11/1993 | Fredrickson | 70/14 |
| 5,275,027 | A * | 1/1994 | Eklof et al. | 70/14 |

(Continued)

FOREIGN PATENT DOCUMENTS

WO 03/080972 A1 10/2003

OTHER PUBLICATIONS

New ScanLock Cuts Theft; advertisement; known prior to Nov. 1, 2011; 1 page; Trion Industries, Inc., Wilkes-Barre, Pennsylvania, USA.

*Primary Examiner* — Jennifer E Novosad
(74) *Attorney, Agent, or Firm* — Reinhart Boerner Van Deuren P.C.

(57) ABSTRACT

A display lock system and display lock used therein are provided. The display lock system includes a display hook having a display lock attached thereto. The display lock includes a lock body attached to a bar of the display hook and a lock bar that surrounds a second bar of the display hook. A lock arrangement operates between the lock body and the lock bar to selectively permit and prohibit movement of the lock bar relative to the lock body.

24 Claims, 12 Drawing Sheets

(56) References Cited

U.S. PATENT DOCUMENTS

| | | | | |
|---|---|---|---|---|
| 5,524,463 | A | 6/1996 | Schenkel et al. | |
| 5,594,228 | A | 1/1997 | Swartz et al. | |
| 5,597,150 | A | 1/1997 | Stein et al. | |
| 5,624,040 | A | 4/1997 | Hono | |
| 5,671,851 | A | 9/1997 | Johnson et al. | |
| 5,676,258 | A * | 10/1997 | Leyden et al. | 211/7 |
| 5,689,978 | A * | 11/1997 | Eklof et al. | 70/62 |
| 5,711,432 | A | 1/1998 | Stein et al. | |
| 6,003,685 | A * | 12/1999 | Malin | 211/7 |
| 6,044,669 | A | 4/2000 | Levi | |
| 6,115,888 | A | 9/2000 | Kraus | |
| 6,226,839 | B1 | 5/2001 | Sayegh | |
| 6,311,531 | B1 | 11/2001 | Sykes | |
| 6,364,124 | B1 | 4/2002 | Chen | |
| 6,393,877 | B1 | 5/2002 | Church | |
| 6,474,478 | B1 | 11/2002 | Huehner et al. | |
| 6,598,433 | B1 | 7/2003 | Malvasio | |
| 6,622,979 | B2 * | 9/2003 | Valiulis | 248/220.42 |
| 6,659,291 | B2 | 12/2003 | Huehner et al. | |
| 6,845,577 | B1 | 1/2005 | Downes | |
| 6,957,555 | B1 * | 10/2005 | Nagel et al. | 70/57.1 |
| 7,197,902 | B1 * | 4/2007 | Barkdoll | 70/57.1 |
| 7,269,983 | B1 * | 9/2007 | Mchatet et al. | 70/14 |
| 7,392,673 | B2 * | 7/2008 | Fawcett et al. | 70/14 |
| 7,533,784 | B2 * | 5/2009 | Vlastakis et al. | 221/258 |
| 7,743,931 | B2 | 6/2010 | Barkdoll | |
| 8,281,624 | B2 * | 10/2012 | Rizzi | 70/14 |
| 8,286,454 | B2 * | 10/2012 | Richardson et al. | 70/14 |
| 8,376,150 | B2 * | 2/2013 | Surma et al. | 211/7 |
| 2004/0026344 | A1 | 2/2004 | Sedon et al. | |
| 2004/0084386 | A1 * | 5/2004 | Huehner et al. | 211/4 |
| 2006/0157431 | A1 * | 7/2006 | Nagelski et al. | 211/54.1 |
| 2007/0283615 | A1 * | 12/2007 | Vlastakis et al. | 43/55 |
| 2007/0289344 | A1 * | 12/2007 | Fawcett et al. | 70/58 |
| 2008/0169250 | A1 * | 7/2008 | Nagelski | 211/7 |
| 2009/0057244 | A1 * | 3/2009 | Conti et al. | 211/7 |
| 2009/0095695 | A1 * | 4/2009 | Moock et al. | 211/57.1 |
| 2009/0173853 | A1 * | 7/2009 | Fawcett et al. | 248/220.31 |
| 2011/0036789 | A1 * | 2/2011 | Richardson et al. | 211/1.57 |
| 2012/0097622 | A1 * | 4/2012 | Surma et al. | 211/7 |

* cited by examiner

FIG. 5
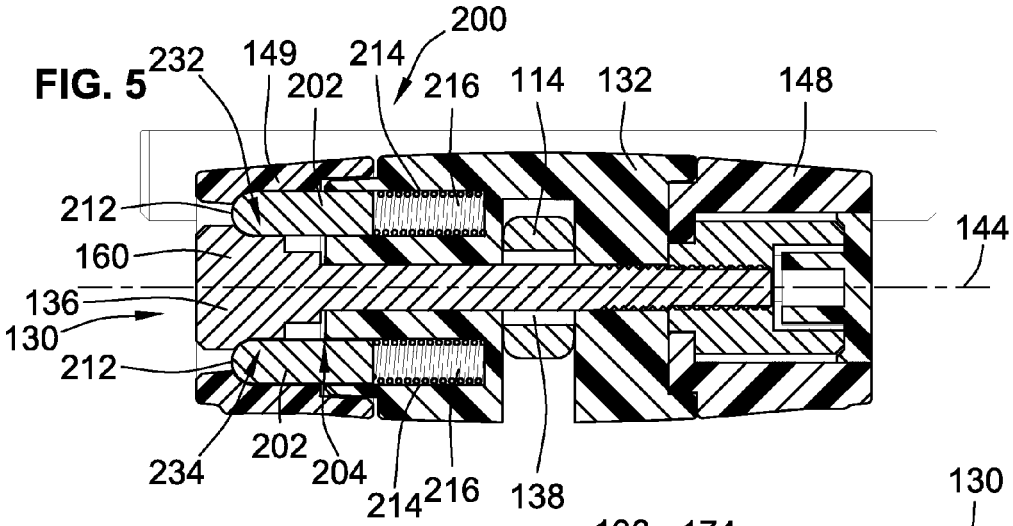
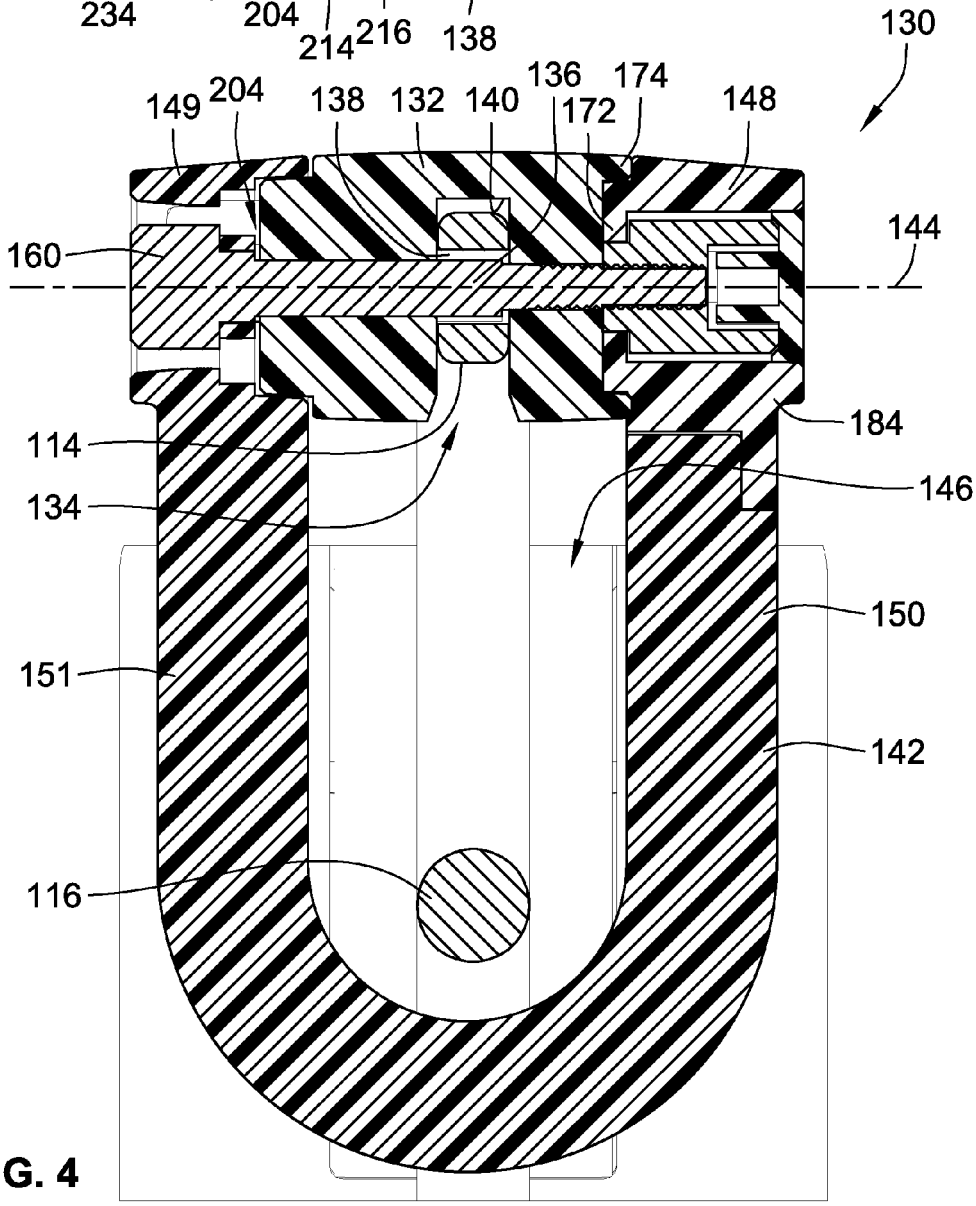
FIG. 4

INVENTORY DISPLAY LOCK

FIELD OF THE INVENTION

This invention generally relates to an inventory display lock, and more particularly to an inventory display lock for use with display hooks that are attached to a merchandise display for holding and displaying merchandise at a retail establishment.

BACKGROUND OF THE INVENTION

There are a variety of different types of display hooks that are presently in wide use. One type of display hook is a "scanner hook" of the type disclosed in U.S. Pat. No. 4,452,360 to Barnes. The scanner hook includes a lower horizontally extending hanger bar for supporting merchandise and an upper parallel bar for supporting a label that includes a price tag which may be "read" by an electronic scanning wand.

Unfortunately, these display hooks by themselves provided little or no theft deterrence to shoplifters. Particularly, shoplifters will steal product by a method know as sweeping. The shoplifter will "sweep" the entire product supported by the lower hanger bar from the display hook in a single motion into a container such as a purse or bag. This method of shoplifting occurs very quickly and results in a significant loss of product. Security display locks have been developed to prevent sweeping by securing or locking the merchandise on the display hook. Such display locks include U.S. Pat. No. 6,957,555 to Nagel et al.; U.S. Pat. No. 6,393,877 to Church; U.S. Pat. No. 5,275,027 to Eklof et al.; U.S. Pat. No. 5,027,622 to Hatch et al.; U.S. Pat. No. 7,197,902 to Barkdoll; and U.S. Pat. No. 7,743,931 to Barkdoll. The present invention relates to improvements in display locks as it relates to theft prevention, reliability, adaptability, practicality, ease-of-use, and/or cost effectiveness.

BRIEF SUMMARY OF THE INVENTION

Embodiments of the present invention relate to new and improved display lock systems and particularly display locks for use with merchandise display systems. The new and improved display lock provides easier access to the display lock for engagement with a key. The new and improved display lock system also includes a protective cover and arrangement for securing a display hook to a display support such as a peg board or slat wall.

In one embodiment, a retail merchandise lock for securing merchandise on a merchandise display hook of a retail display is provided. The retail merchandise lock comprises a lock body, a lock bar and lock arrangement between the lock body and the lock bar. The lock body defines a mounting channel for receiving an bar or bar of the merchandise display hook therethrough. The lock bar is rotatably coupled to the lock body for rotation about a lock bar axis. The lock bar defines a lock bar aperture configured to receive a second bar of the merchandise display hook therethrough in a direction that is substantially perpendicular to the lock bar axis. The lock arrangement acts between the lock bar and the lock body. The lock arrangement has a locked state in which the lock bar is prevented from rotating about the lock bar axis relative to the lock body, and an unlocked state in which the lock bar is allowed to rotate about the lock bar axis relative to the lock body. In one embodiment, the lock bar does not affect the mounting of the display lock to the display hooks.

In one embodiment, an attachment pin extends through the mounting channel for securing the lock body to the bar. The attachment pin is spaced away from a bottom of the mounting channel which is generally trough shaped. The attachment pin and mounting channel are configured such that the attachment pin can pass through an aperture formed through the bar of the merchandise display hook.

In one embodiment, the lock arrangement includes a lock pin. The lock pin extends across a shear interface formed between the lock body and the lock bar. The lock pin engages both the lock body and the lock bar in the locked state to prevent rotation of the lock bar relative to the lock body in the locked state. The lock pin does not extend across the shear interface and not engaging the lock bar in the unlocked state to allow rotation of the lock bar relative to the lock body in the unlocked state. The lock pin is slidable between the locked and unlocked states along a pin axis and relative to the lock body.

In one embodiment, a spring member biases the lock pin toward the locked state.

In another embodiment, the lock pin is slidably carried in a lock pin channel formed in the lock body. The lock bar includes a first pin pocket. The lock pin extends into the first pin pocket in the locked state and is removed from the first pin pocket in the unlocked state. The lock pin engages the portion of the lock bar forming/bounding the first pin pocket in the locked state to prevent rotation of the lock bar relative to the lock body.

In one embodiment, the lock bar includes a key slot arranged to receive a key therein in a direction extending generally parallel to the pin axis of the lock pin. The key slot aligns with the lock pin providing access to the pin for axially engaging and biasing the pin to the unlocked state along the pin axis.

In one embodiment, the key slot is non-circular such that rotation of the key within the key slot will cause rotation of the lock bar.

In one embodiment, the lock bar is generally clevis shaped including a first leg portion and a second leg portion. The lock body is interposed between the first and second leg portions. In a more particular embodiment, an attachment pin extends through a first end of the first leg portion, through the lock body and into a second end of the second leg portion. The attachment pin is co-axial with the lock bar axis. The attachment pin maintains the lock body in a sandwiched relationship between the first and second ends.

In a more particular embodiment, the attachment pin includes first and second end portions. The first end of the first leg portion includes a first abutment plate through which the attachment pin extends, the first abutment plate configured to prevent passage of the first end portion of the attachment pin therethrough. The second end of the second leg portion includes a second abutment plate through which the attachment pin extends. The second abutment plate is configured to prevent passage of the second end portion therethrough. The first and second abutment plates are positioned between the first and second end portions to secure the merchandise lock in an assembled state.

In one embodiment, the attachment pin is a bolt and the first end portion is a head of the bolt and the second end portion is a nut threaded onto an end of the bolt. The first end of the first leg is detachable from the rest of the lock bar to assist mounting to a bar of the display hook.

In one embodiment, a key is provided for transitioning the lock arrangement between the locked and unlocked states. The first end of the first leg portion includes a key receiving aperture configured to receive the key for engagement of the key with the lock arrangement. In a more particular embodiment, the key includes a central aperture. The central aperture receives the first end portion of the attachment pin when the key is inserted into the key receiving aperture.

In one embodiment, the lock bar includes a second pin pocket. The lock pin extends into the second pin pocket in a second locked state that is different than the other locked state. Preferably, the lock bar is in a second angular orientation relative to the lock body in the second locked state.

In a further implementation of the invention, a retail display system or display lock system is provided. The display lock system a merchandise display hook and a display lock. The display hook has first and second bars. The second bar is configured to carry merchandise. Typically, the second bar is below the first bar. The display lock includes a lock body, a lock bar and a lock arrangement. The lock body defines a mounting channel for receiving the first bar of the merchandise display hook therethrough. The lock bar rotatably coupled to the lock body for rotation about a lock bar axis that is generally perpendicular to the first and second bars of the merchandise display hook. The lock bar and lock body form a complete securing loop that surrounds the second bar. The lock arrangement acts between the lock bar and the lock body. The lock arrangement has a locked state in which the lock bar is fixed relative to the lock body in a closed state relative to the second bar where the lock bar inhibits removal of merchandise from the second bar. The lock arrangement has an unlocked state in which the lock bar is allowed to rotate about the lock bar axis relative to the lock body to an open state where the lock bar does not inhibit removal of merchandise from the second bar.

In one embodiment, the first bar includes a mounting aperture therethrough. The display lock includes an attachment pin. The attachment pin extends through the mounting channel and the mounting aperture to secure the lock body and lock bar to the first bar.

In one embodiment, the attachment pin is co-axial with the lock bar axis.

In one embodiment, the lock bar includes first and second leg portions that are spaced apart from one another along the lock bar axis. The first and second leg portions are coupled together by a bend or bent portion. The second bar of the display hook extends through a cavity formed between the first and second leg portions, the lock body, and the bend when the lock bar is in the closed state. The second bar does not pass through the cavity when the lock bar is in the open state.

In one embodiment, a support structures is provided to which the merchandise display hook is attached. The merchandise display hook further includes a metal stamping including at least one bent foot operably engaging the support structure to secure the merchandise display hook to the support structure. A protective cover extends over at least a portion of the metal stamping and includes a bent foot operably engaging the support structure to secure the protective cover to the support structure. The protective cover operably engages the metal stamping to secure the metal stamping to the support structure.

In one embodiment, the protective cover includes a cover body that is generally U-shaped defining a channel between a pair of legs. The protective cover is engaged with the metal stamping. The top and bottom bars are positioned between the pair of legs.

In one embodiment, the metal stamping includes first and second wings that are positioned proximate a front face of the support structure when mounted thereto. A first wall extends outward from and is connected to the first wing and a second wall extends outward from and is connected to the second wing. An intermediate portion extends between and connects the first and second walls. The intermediate portion is positioned between the pair of legs of the protective cover. A gap is formed between the intermediate portion and the front face of the support structure. The at least one bent foot of the metal stamping is connected to at least one of the first and second wings.

In another embodiment, the first and second walls include catch recesses formed in outer surfaces thereof. The protective cover includes an inward extending catch on each leg. The catches cooperate with the catch recesses to create the engagement between the protective cover and the metal stamping. This arrangement covers the metal stamping to prevent the metal stamping and the display hook from being removed from the retail support structure, e.g. peg board or slat wall.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIGS. 4 and 5 are cross-sectional illustrations of the display lock of FIG. 1;

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
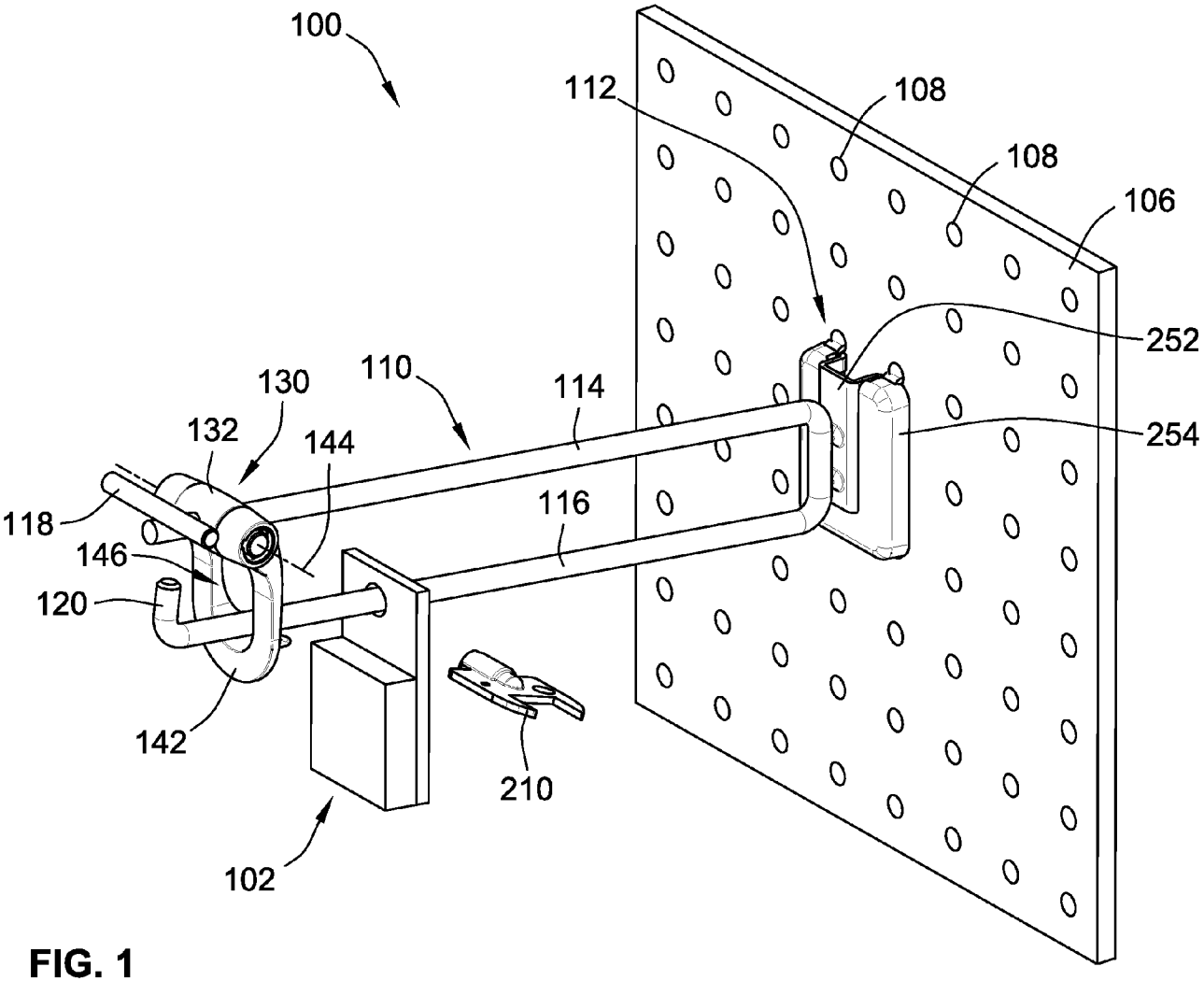
FIG. 1 is a front top view of a display lock system according to an embodiment of the present inventions with the display lock in a closed state.

An exemplary embodiment of a display lock system 100 in accordance with the invention is illustrated in FIG. 1. The display lock system 100 is used to securely display merchandise 102 for sale to customers in a retail establishment. The display lock system 100 allows for selective removal of the merchandise 102 therefrom. This configuration prevents sweeping as discussed above.

The display lock system 100 includes a vertical support in the form of a pegboard 106 having numerous apertures 108, in the illustrated embodiment. It is also noted that, while the current display lock system 100 uses a pegboard, other retail fixtures can be used with the current display lock system. More particularly, the display hooks 110, which are illustrated as scanning style hooks for pegboards, could be attached to slat walls or other types of vertical support structures. A display hook 110 for carrying the merchandise 102 is mounted to and extends outward from a front face of the pegboard 106. The display hook 110 has a rear mount 112 adapted to selectively attach the display hook 110 to the apertures 108 of the pegboard 106. Further, the display hooks 110 could be permanently attached to the vertical support such as being welded to the vertical support or to a shelf.

The display hook 110 is a scan style retail hook that includes a top bar 114 and a bottom bar 116 extending in a forward direction outward from the rear mount 112. The top bar 114 is vertically displaced above and generally parallel to the bottom bar 116. Typically, but not required, the top and bottom bars 114, 116 are formed from a single continuous piece of metal rod or wire that is bent into a generally U-shaped member.

The front end of the top bar 114 terminates in a stop 118 in the form of a cross-wire configured for attaching a sign holder. In the illustrated embodiment, the stop 28 is a laterally extending piece of rod that is perpendicular to the top and bottom bars 114, 116. However, in other alternative embodiments the stop could be a bend in the free end of the top bar 114. Other forms of a stop could be provided or merely a sign holder could be provided that is permanently attached to the top bar 114.

The front or distal end of the bottom bar 116 terminates in a bent free end 120. The bent free end 120 extends upwards towards the top bar 114. The bottom bar 116 carries the displayed merchandise 102 and the bent free end 120 helps retain merchandise 102 on the bottom bar 116 when merchandise is allowed to be removed from the display lock system 100.

Figure 2:
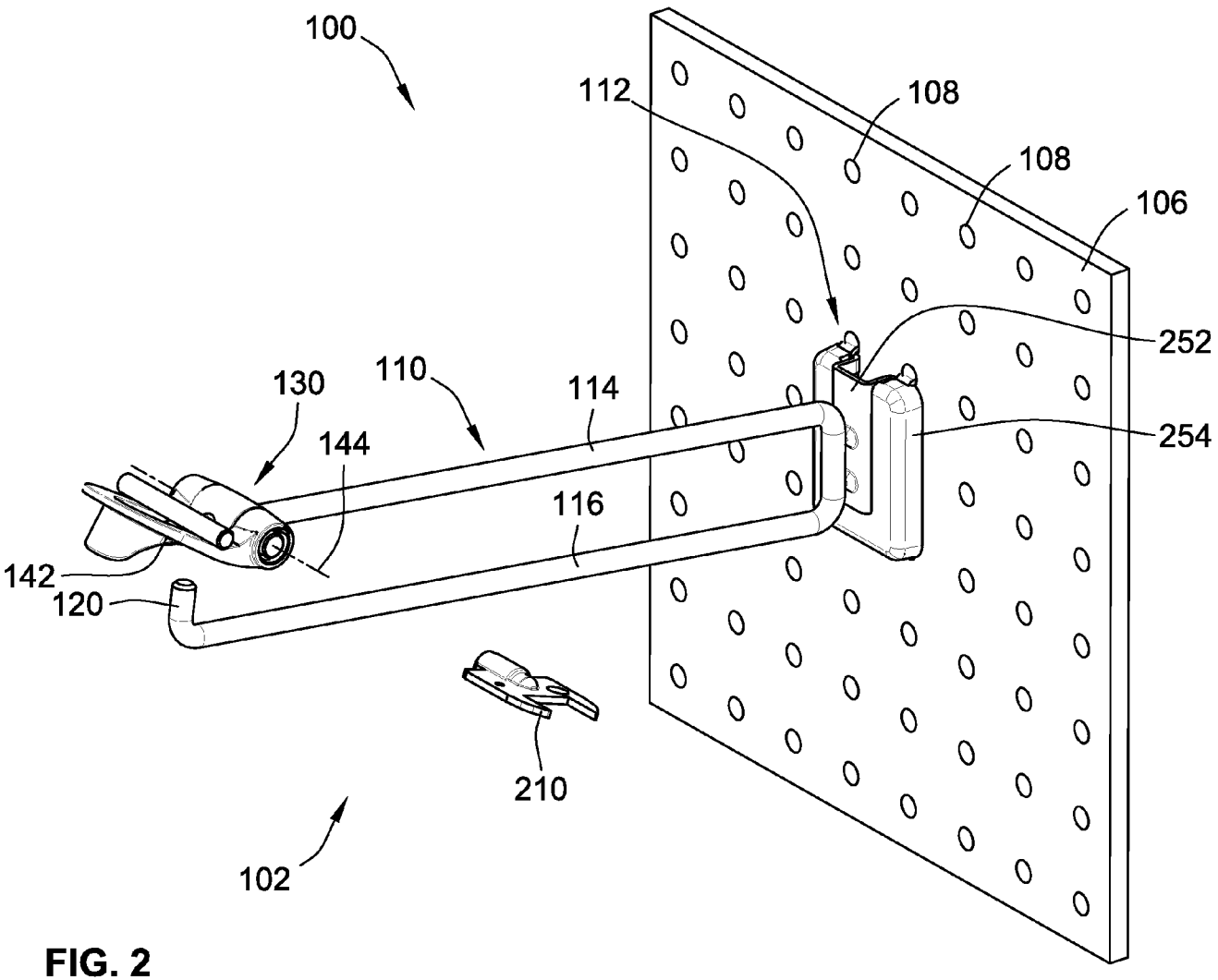
FIG. 2 is a top front illustration of the display lock system of FIG. 1 with the display lock in the open state.

The display lock system 100 includes a display lock 130 attached to the display hook 110 to inhibit removal of merchandise 102 from the bottom bar 116. The display lock 130 is illustrated in a closed state wherein the display lock 130 prevents removal of the merchandise 102 from the bottom bar 116. The display lock system 100 is illustrated in FIG. 2 in an open state such that the display lock 130 does not inhibit removal of the merchandise 102 from the bottom bar 116.

Figure 3:
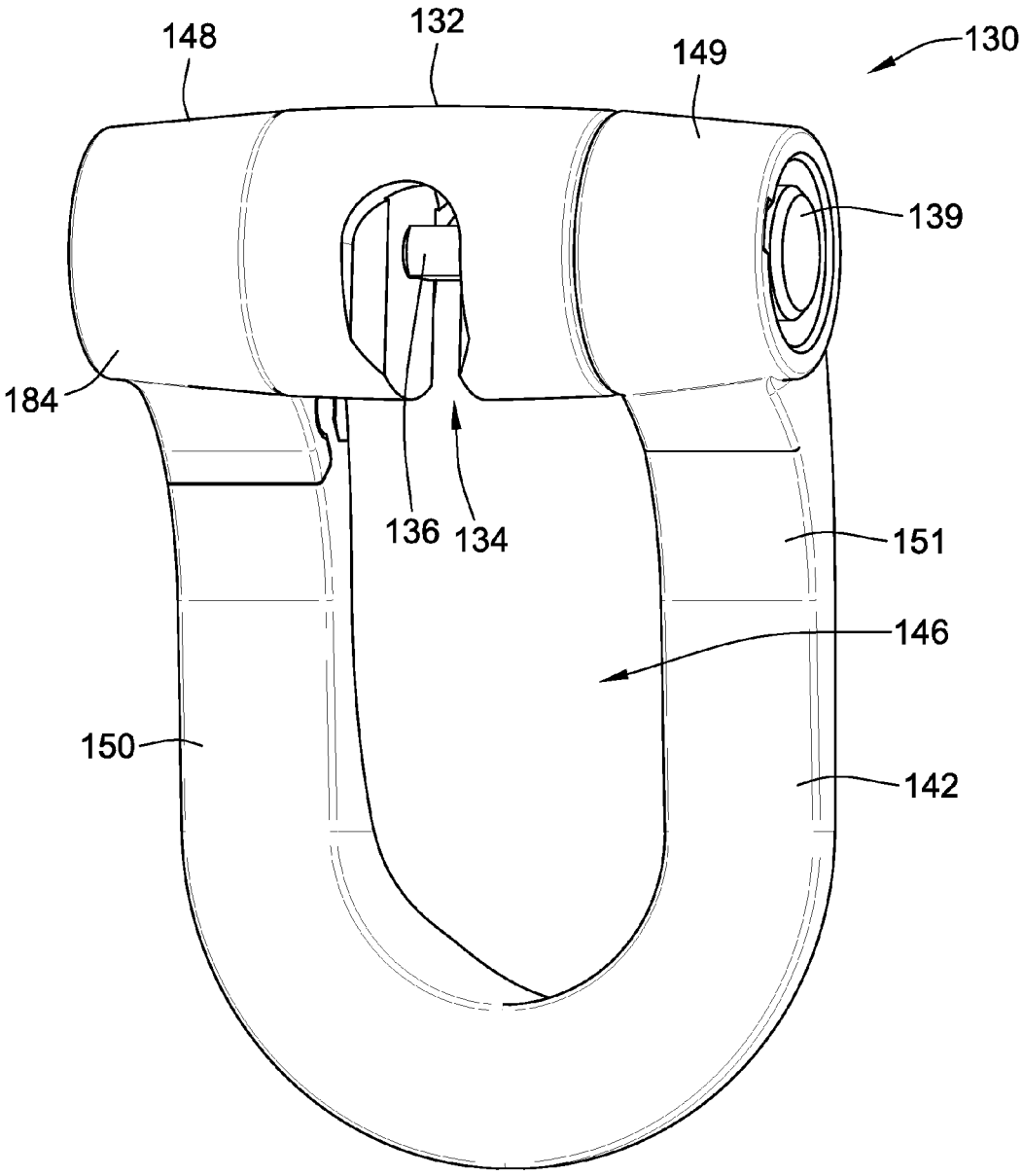
FIG. 3 is a front view of the display lock of the display lock system of FIG. 1.
Figure 6:
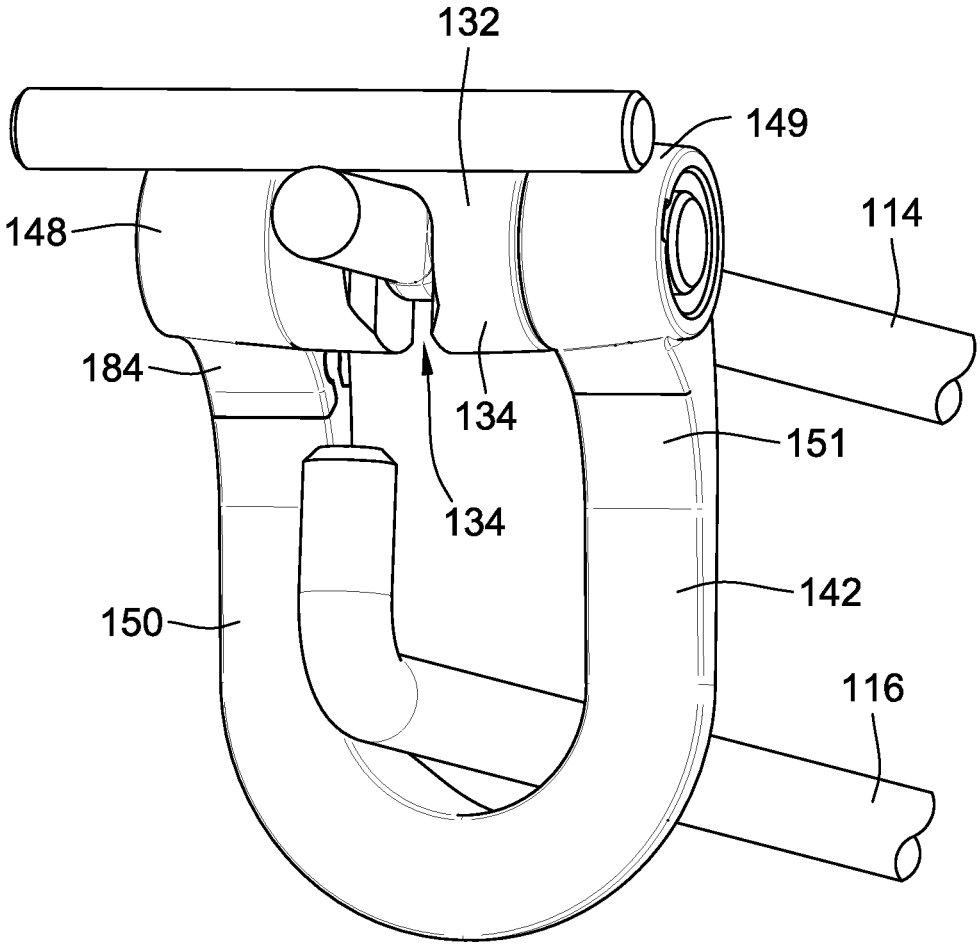
FIG. 6 is an enlarged front bottom illustration of the display lock system of FIG. 1.

With reference to FIGS. 3 and 4, the display lock 130 generally includes a lock body 132 defining a mounting channel 134 and an attachment pin 136 for securing the lock body to the display hook 110 and particularly to the top bar 114 of the display hook 110. The lock body 132 will saddle top bar 114 when mounted. The mounting channel 134 is sized to receive the top bar 114 therein. The top bar 114 includes an aperture 138 (see also FIG. 5) formed in a coined/flattened portion through which the attachment pin 136 extends to fixably attach the lock body 132 to the top bar 114 with the top bar 114 extending through the mounting channel 134. The mounting channel 134 defines a bottom 140 from which the attachment pin 136 is spaced to allow a portion of the top bar 114 to be positioned therein. The attachment pin 136 extends entirely through the mounting channel 134 from one side to the other.

The display lock 130 includes a lock bar 142 rotatably coupled to the lock body 132 for rotation about a lock bar axis 144 relative to the lock body 132. This configuration allows the lock bar 142 to transition between the closed state and the open state discussed previously to selectively allow removal of merchandise 102. The lock bar 142 is generally U-shaped and defines a lock bar aperture 146 configured to receive the distal bent free end 120 of the bottom bar 116 of the display hook 110 therethrough in a direction that is substantially perpendicular to the lock bar axis 144. When the display lock 130 is in the closed state (see FIG. 1), the display lock 130 surrounds the distal end of the bottom bar 116 to prevent removal of merchandise 102 therefrom.

Figure 7:
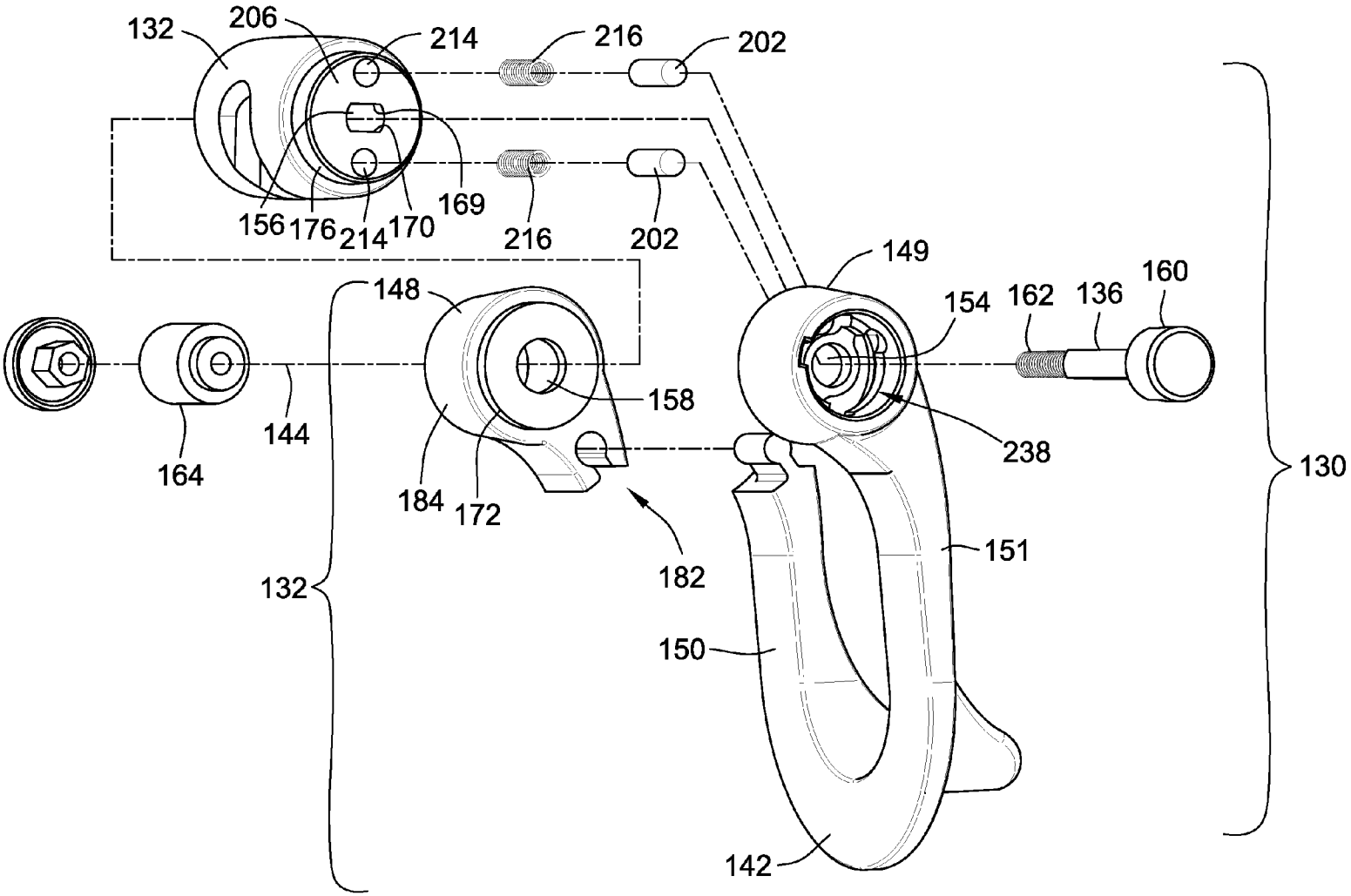
FIGS. 7 and 8 are right and left exploded illustrations of the display lock of the display lock system of FIG. 1.
Figure 8:
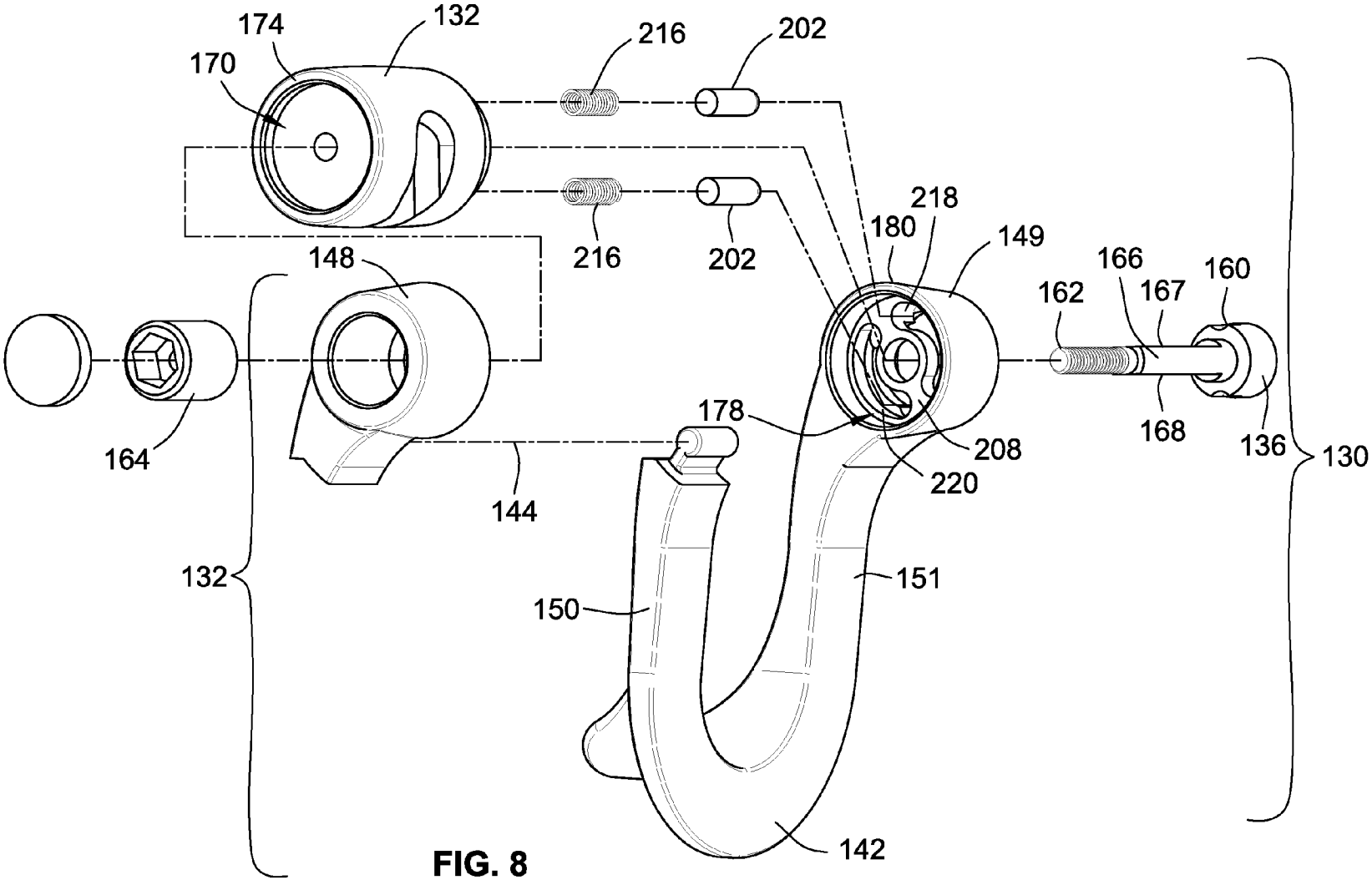

With additional reference to FIGS. 7 and 8, the lock body 132 is axially positioned between distal ends 148, 149 of first and second leg portions 150, 151. Distal end 148 is formed from a separate component 184 as the rest of the lock bar 142 to assist in assembly of the display lock 130.

The attachment pin 136 of the illustrated embodiment is generally in the form of a screw that extends through an aperture 150 in distal end 149 and then through an aperture 156 in the lock body 132 and then finally through an aperture 158 in the other distal end 148. The first end of the attachment pin has an enlarged head portion 160 and an opposed threaded end 160. The enlarged head portion 160 is larger in dimension than aperture 154 through distal end 149 to prevent complete passage of the attachment pin 136 therethrough. The threaded end 162 mates with a lock nut 164 to secure the attachment pin 136 in distal ends 148, 149 and lock body 132 and secure the components in an assembled state.

As illustrated in FIG. 8, the attachment pin includes a central portion 166 axially positioned between the threaded end 162 and enlarged head portion 160. The central portion 166 includes two opposed flats 167, 168 that prevent rotation of the attachment pin 136 relative to the lock body 132. As illustrated in FIG. 7, the lock body 132 includes corresponding flats 169, 170 forming part of the boundary of the aperture 156 therethrough. In some embodiments, the aperture through the top bar 114 has similar flats to prevent rotation of the attachment pin 136 relative thereto. The attachment pin 136 extends through the first and second leg portions 150, 151 and is coaxial with the lock bar axis 144 in the illustrated embodiment. The attachment pin 136 maintains the lock body 132 in a sandwiched relationship between the distal ends 148, 149 of the lock bar 142.

The lock body 132 includes a recessed end 170 that receives an axially extending cylindrical hub 172 when the display lock 130 is assembled. The interaction between the hub 172 and the shoulder 174 provided by the recessed end 170 permits relative rotation between the lock body and the distal end 148. The opposed end of the lock body 132 includes a hub 176 that is axially received in a recess 178 that also provides a shoulder 180. The interaction of this hub 176 with shoulder 180 further supports the lock bar 142 relative to the lock body 132 for rotational motion therebetween. It should be noted that the recesses and hubs and recess of the lock body could be provided by the lock bar and similarly the hubs and recess of the lock bar could be provided by the lock body. Further, all recesses could be provided by either the lock bar or lock body and all hubs could be provided by the lock bar or lock body where appropriate.

As noted above, distal end 148 is formed from a separate component 184 from the rest of lock bar 142. The separate component and the rest of the lock bar 142 have a mating interface 182 that is generally a dovetail arrangement. The mating interface 182 is configured to allow the separate component 184 to slide axially parallel to the rotational lock bar axis 144 to assist in assembly of the display lock 130. It should be noted that the hubbed arrangement discussed above is not necessary, however it is beneficial to maintain engagement of the lock body 132 relative to the lock bar 142 while mounting the display lock 130 to the top bar 114. The mating relationship prevents the lock body 132 from falling out from between the distal ends 148, 149 when the attachment pin 136 is moved axially out of the apertures 154, 156, 158 discussed above.

Figure 9:
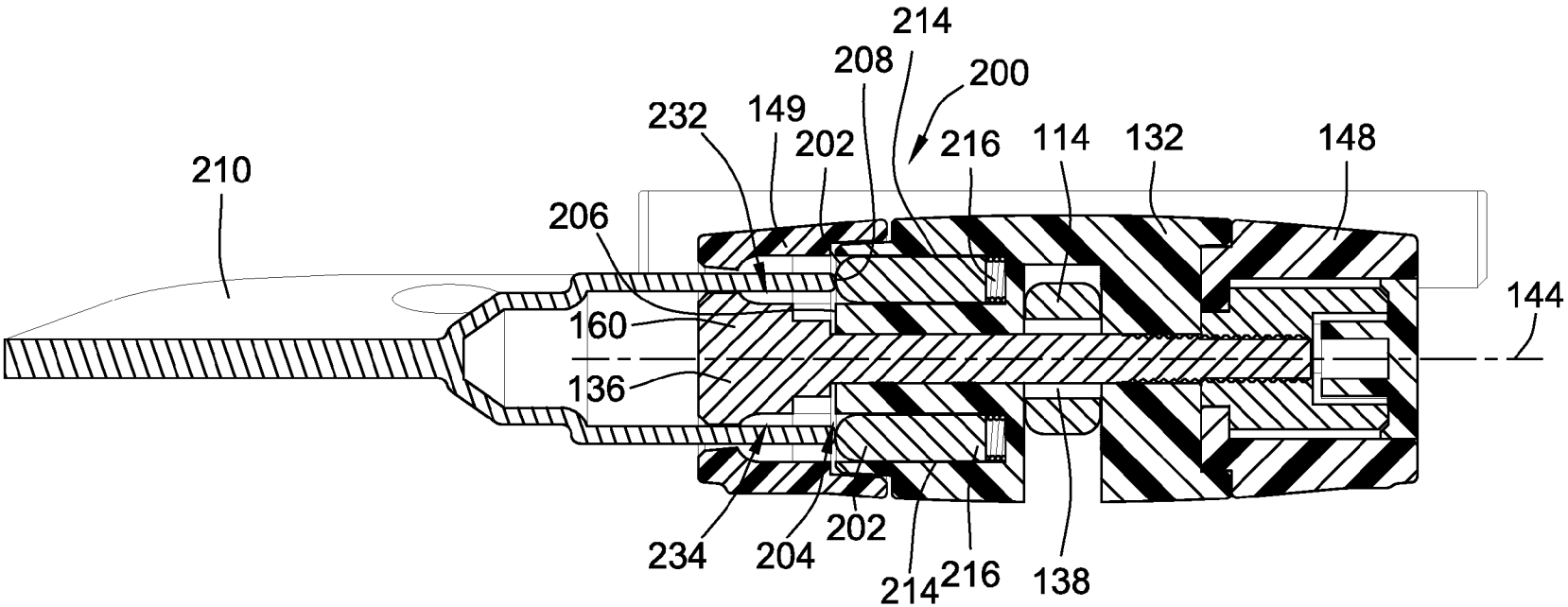
FIG. 9 is a cross-sectional illustration of the display lock in the unlocked state.

With primary reference to FIGS. 5 and 9, the display lock 130 includes a lock arrangement 200 interposed between the lock body 132 and the lock bar 142. The lock arrangement 200 can be manipulated between a locked state (FIG. 5) and an unlocked state (FIG. 9). In the locked state, angular rotation of the lock bar 142 relative to the lock body 132 is prevented. Therefore, the lock arrangement prevents transition of the display lock 130 from the closed state to the open state (see FIGS. 1 and 2 discussed above).

The lock arrangement 200 generally includes at least one lock pin and in the illustrated embodiment a pair of lock pins 202 extending across a shear interface 204 positioned axially between the lock body 132 and the lock bar 142. More particularly, the shear interface 204 is positioned between distal end 206 of hub 176 and inner face 208 of distal end 149. The distal end 206 and the face thereof axially faces the inner face 208 of distal end 149 of leg portion 151.

In the locked state, the lock pins 202 engage both the lock body 132 and the lock bar 142 to prevent rotation of the lock bar 142 relative to the lock body 132 about the lock bar axis 144. In the unlocked state, the lock pins 202 do not extend across the shear interface 204 and do not engage the lock bar 142, and particularly the distal end 149 thereof. Because the lock pins 202 do not engage the lock bar 142, rotational motion therebetween is permitted.

The lock pins 202 are axially slideable relative to the lock bar 142 and lock body 132 between the locked and unlocked states. A key 210 can cooperate with the lock pins 202 to transition the lock pins to the unlocked state. The key 210 will engage distal ends 212 of the lock pins 202 and push the lock pins 202 past the shear interface 204. With the distal ends 212 pushed past the shear interface 204, the lock bar 142 is permitted to rotate relative to the lock body 132 at the rotation interface between the hub 176 and shoulder 180.

With additional reference to FIG. 7, the lock pins 202 are slideably carried in a locked pin channels 214 formed in the lock body 132 between the locked and unlocked states (see FIGS. 5 and 9). Return spring members 216 may also be carried in the lock pin channels 214 to bias the lock pins 202 towards the locked state and particularly biasing the lock pins 202 axially out of the lock pin channels 214 such that the lock pins 202 are positioned across the shear interface 204. The lock pins 202 and springs 214 act as plungers.

Figure 10:
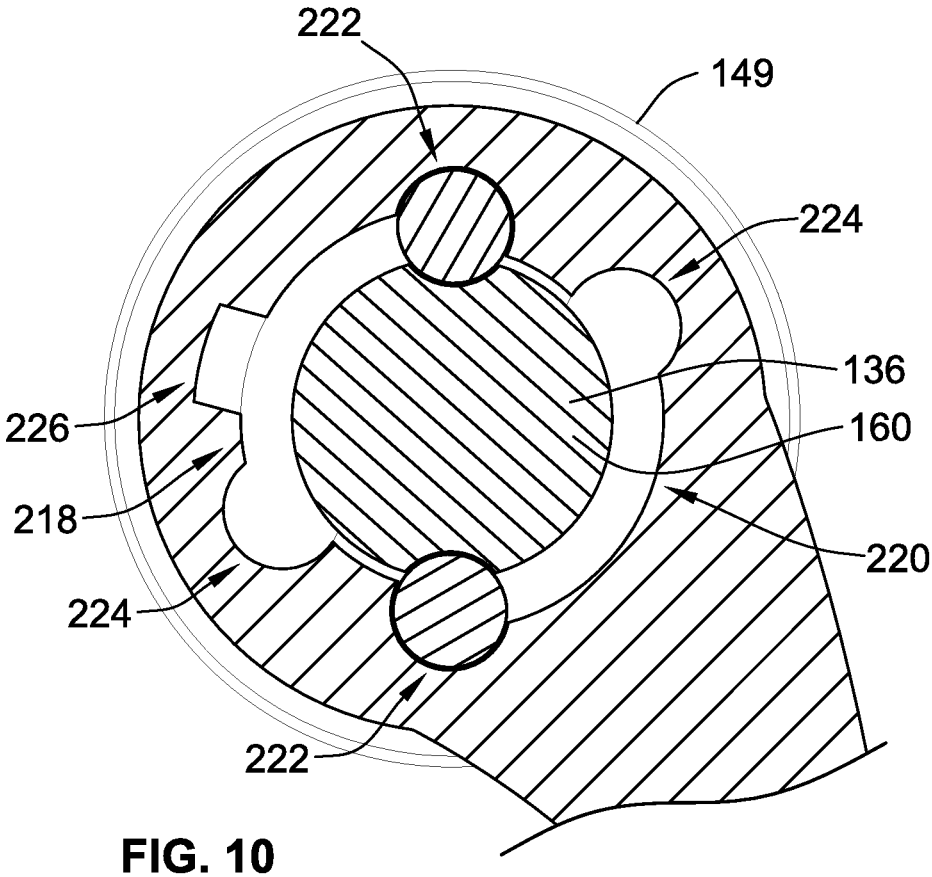
FIG. 10 is a cross-sectional illustration of the display lock in a locked state.

With additional reference to FIG. 10, the distal end 149 has an abutment plate that defines a pair of key slots 218, 220 through which the key extends to unlock the display lock. At one end, key slots 218, 220 include a pin retaining pocket 222 that the lock pins 202 extend into in the closed state and are removed from in the open state. The pin retaining pockets 222 are configured such that the lock pin engages the portion of the lock bar 142 forming the pin retaining pockets in the locked state to prevent rotation of the lock pins 202 relative to the distal end 149 of the lock bar 142 when the lock pins 202 are positioned within the pin retaining pockets 222. The key slots 218, 220 are generally arc shaped and are configured to receive a key therein in a direction extending generally parallel to the longitudinal axis of the lock pins 202. This is also generally parallel to lock bar axis 146. The pin retaining pockets 222 in the illustrated embodiment are formed at the ends of the key slots 218, 220. The lock pins 202 engage a first set of the pin retaining pockets 222 when the lock bar is in the open state.

The abutment plate can define arcuate channels in which the distal end 212 of the lock pins 202 can be positioned in the unlocked state while rotating the lock bar 142 relative to the lock body 132. The lock pins 202 need not be entirely recessed within lock pin channels 214 of the lock body, as illustrated in FIG. 9.

In the open state, the key 210 can be removed from the display lock 130 and the lock pins 202 can be inserted into the pin retaining pockets 224 at the opposite ends of the key slots 218, 220. In this configuration, the lock pins 202 are used to maintain the lock bar 142 in the open state such that the user can load merchandise on to the bottom bar 116 with the lock bar 142 maintained in a location where it will not interfere with loading the bottom bar 116 with merchandise 102.

The illustrated embodiment uses two fixed configurations where the lock bar 142 is either in the closed state (see FIG. 1) or the open state (see FIG. 2). Other designs could have the lock pins 202 cooperate with the distal end 149 of lock bar 142 in the open state such that the engagement therebetween is sufficient to maintain the lock bar 142 in the released state but not so strong that the user cannot merely transition lock bar 142 to the lock state when finished. Such an arrangement would be configured such that the lock pin 202 would drop into a minimally recessed cavity of the lock bar 142 rather than the deeper slots that are currently illustrated. This would only provide limited resistance to transitioning the lock bar 142 to the secured state from the released state.

The lock bar 142 can include an angular key orientation slot 226 in which a radially extending projection of the key 210 can extend. This allows the manufacturer to modify the angular location of the angular key orientation slot 226 relative to the rest of the key slots 218, 220 for providing different keyed arrangements between the key 210 and the display lock 130.

As illustrated in FIG. 5, the enlarged head portion 160 of the attachment pin 136 includes notched portions 232, 234 in the outer periphery thereof in which the distal ends 212 of the lock pins 202 extend in the locked state. This engagement between lock pin 202 and the enlarged head portion 160 further assists in preventing rotation of the lock bar 142 relative to the lock body 132 in the locked state.

The key slots 218, 220 are configured in size to receive corresponding shaped and sized end portion of the key 210. The key slots 218, 220 are therefore axially aligned with the lock pin channels 214 such that the distal end of the key 210 can engage the distal end 212 of the lock pins 202.

The distal end 149 of lock bar 142 defines a key receiving aperture configured to receive the key 218 for engagement of the key 218 with the lock pins 202. The key 210 includes a central aperture. The central aperture of the key 210 receives the enlarged head portion 160 of the attachment pin 136 when the key 210 is inserted into the key receiving aperture 238. The distal end 149 and the enlarged head 160 define a channel therebetween that forms a portion of the key receiving aperture 238.

Additionally, due to the inclusion of the key projection 228 on the key, the display lock 130 can be configured such that once the key is rotated from the state illustrated in FIG. 1 to the state illustrated in FIG. 2, the key cannot be removed from the display lock 130. This is one way to attempt to remind the user that the display lock 130 is in the released state such that merchandise can be removed from the bottom bar 116.

With reference to FIG. 1, the rear mount 112 is illustrated mounting the plate hook 110 to the pegboard 106. Rear mount 112 includes a metal stamping 252 that is operably welded to the vertical portion of the display hook 110 extending between the top and bottom bars 114, 116. The rear mount 112 also includes a plastic protective cover 254 that engages with the metal stamping 252 to secure the peg hook 110 to the pegboard 106. The use of the protective cover 254 conceals the metal stamping 252 to prevent complete theft of the display hook 110 including the merchandise 102 attached thereto. The interaction between the metal stamping 252 and protective cover 254 is configured such that a tool is required to disengage the two components to allow the display hook 110 to be removed from the pegboard 106. Typically, the handle end of the key 210 is configured to disengage the two components.

With additional reference to FIGS. 11-15 the operation of the rear mount 112 will be described.

Figure 11:
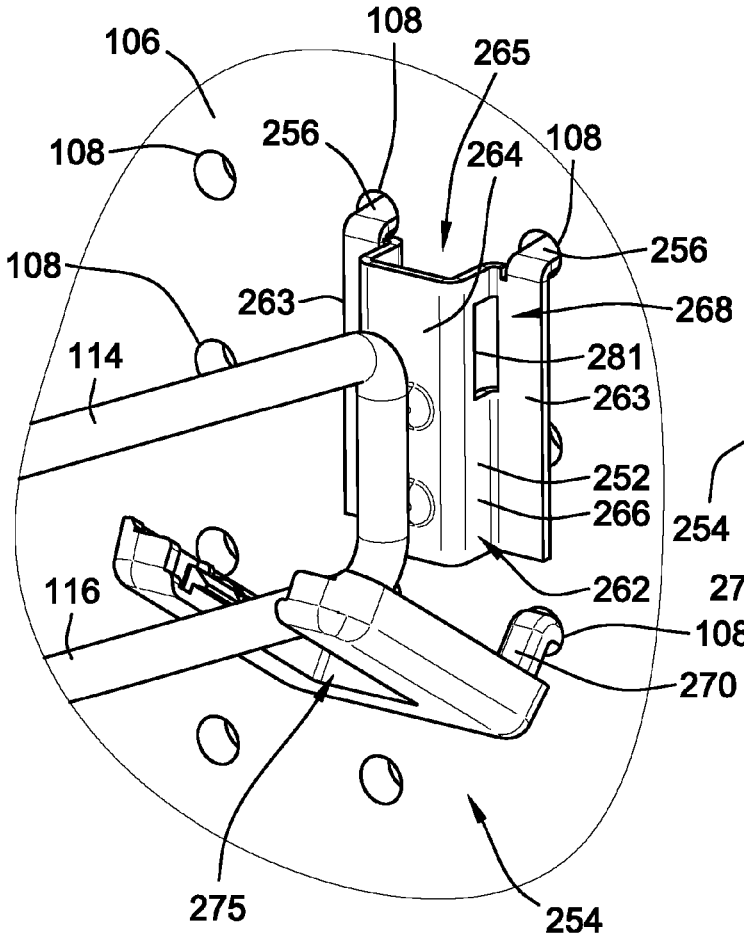
FIG. 11 is a top front illustration of the rear mount of the display lock system of FIG. 1 in an open state.
Figure 12:
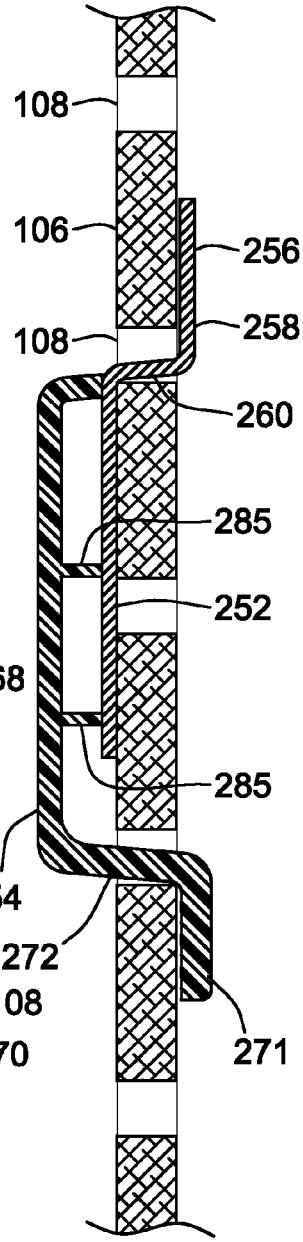

With primary reference to FIGS. 11 and 12, the metal stamping 252 includes a pair of bent feet 256 that extend through adjacent apertures 108 in the pegboard 106. The feet 256 include a back portion 258 and an extension portion 259 that extend generally perpendicular to one another. The back portion 256 will remain behind and generally parallel with the pegboard 106 when the metal stamping 252 is mounted to the pegboard. The extension portion 259 will extend axially through the aperture 108 in the pegboard 106 and connect the front body portion 262 of the stamping 252 to the back portion 258.

When mounting the stamping 252 to the pegboard 106, the user will insert the back portion 258 through the aperture 108 and then rotate the stamping approximately 90° such that the front portion rests against the front surface of the pegboard 106. During the rotation step, the extension portion 260 will then extend through the aperture 108.

The front body portion 262 includes a pair of wing sections 263 that connect to a central portion 264 that connects the two wing portions 263 to one another. The central portion 264 is configured to be spaced from the front surface of the pegboard 106 to define a cavity 265 between the front surface of the pegboard 106 and the central portion 264. The front body portion 262 includes a pair of upstanding wall portions 266 that extend outward from the wing sections 263 to connect the central portion 264 to the wing portions 263. The upstanding wall portions 266, in the illustrated embodiment, extend generally perpendicular to both the wing sections 263 and the central portion 264. These upstanding wall portions 266 space the central portion 264 from the front surface of the pegboard 106 to define cavity 265.

The upstanding wall portions 266 include attachment recesses in the form of cavities 268. These cavities 268 are used for attaching the protective cover 254 to the metal stamping 252 when the display hook 110 is attached to the pegboard 106. In other embodiments, the recesses need not extend entirely through the upstanding wall portions 266.

The protective cover 254 generally includes a pair of bent feet 270 that are configured much like the feet 256 of the metal stamping. The bent feet 270 include a back portion 271 and extension portion 272 that operate just like that of the bent feet 256 of the metal stamping 252. As such, the protective cover 254 is mounted to the pegboard 106 by inserting the back portion 271 through an aperture 108 in the pegboard 106 and then rotating 90° to locate the extension portion 272 within the aperture with the back portion 271 adjacent and generally parallel to the back surface of the pegboard 106.

The protective cover 254 includes a generally U-shaped body 274. The U-shaped body 274 generally includes a pair of interconnected leg portions 276 that form a channel 275 therebetween.

A pair of latch catches 278 extend laterally into the channel 275. The latch catches 278 are resilient and are configured to snap into the cavities 268 of the upstanding wall portion 266 of the metal stamping 252. These latch catches 278 will secure the protective cover 254 to the metal stamping 252 to prevent the protective cover 254 from being removed from the metal stamping 252 when the two components are connected to prevent removal of the display hook 110 from the pegboard 106. The latch catches 278 have canted outer faces that act as cams and allow for sliding the latch catches 278 across the upstanding wall portion 266 while rotating the protective cover 254 into the mounted state as illustrated in FIG. 1. The canted surfaces assist in flexing the latch catches 278 away from one another during the mounting process. The latch catches 278 include a flat catch surface that cooperates with a corresponding flat catch surface 281 defined by the cavity 268.

By having the U-shaped body 274 with channel 275, the protective cover 254 can be rotated past the top and bottom bars 114, 116 of the display hook 110 during assembly. The top and bottom bars 114, 116 extend through the channel 275 and are interposed between the leg portions 276 when assembled.

A key or tool must be inserted into cavity 265 such that it flexes the latch catches 278 laterally away from one another and out of engagement with the catch surfaces 281 of the metal stamping 252 to remove the protective 254 from the metal stamping.

Figure 13:
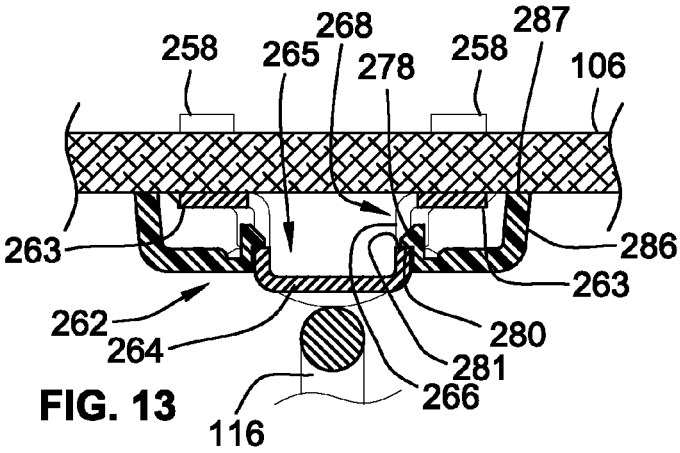
FIGS. 12 and 13 are cross-sectional illustrations of the rear mount of the display lock system of FIG. 1.
Figure 14:
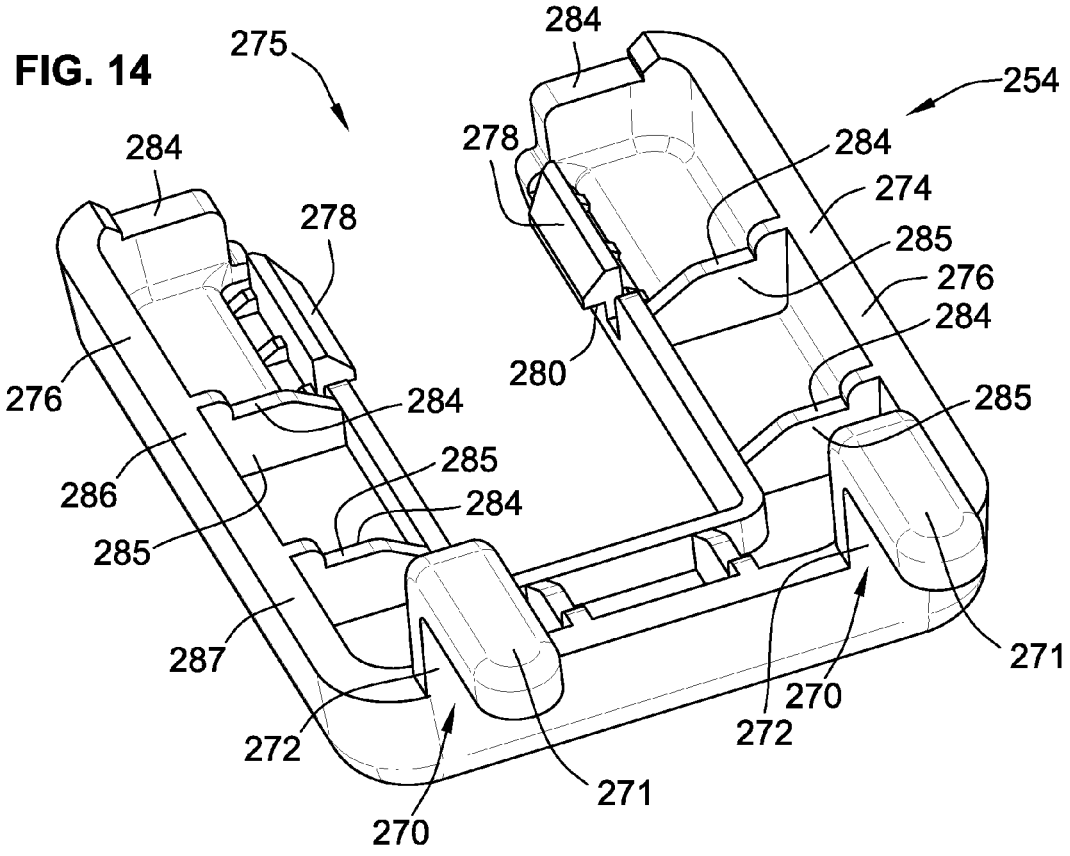
FIG. 14 is a rear illustration of the plastic protective cover of the rear mount of the display lock system of FIG. 1.
Figure 15:
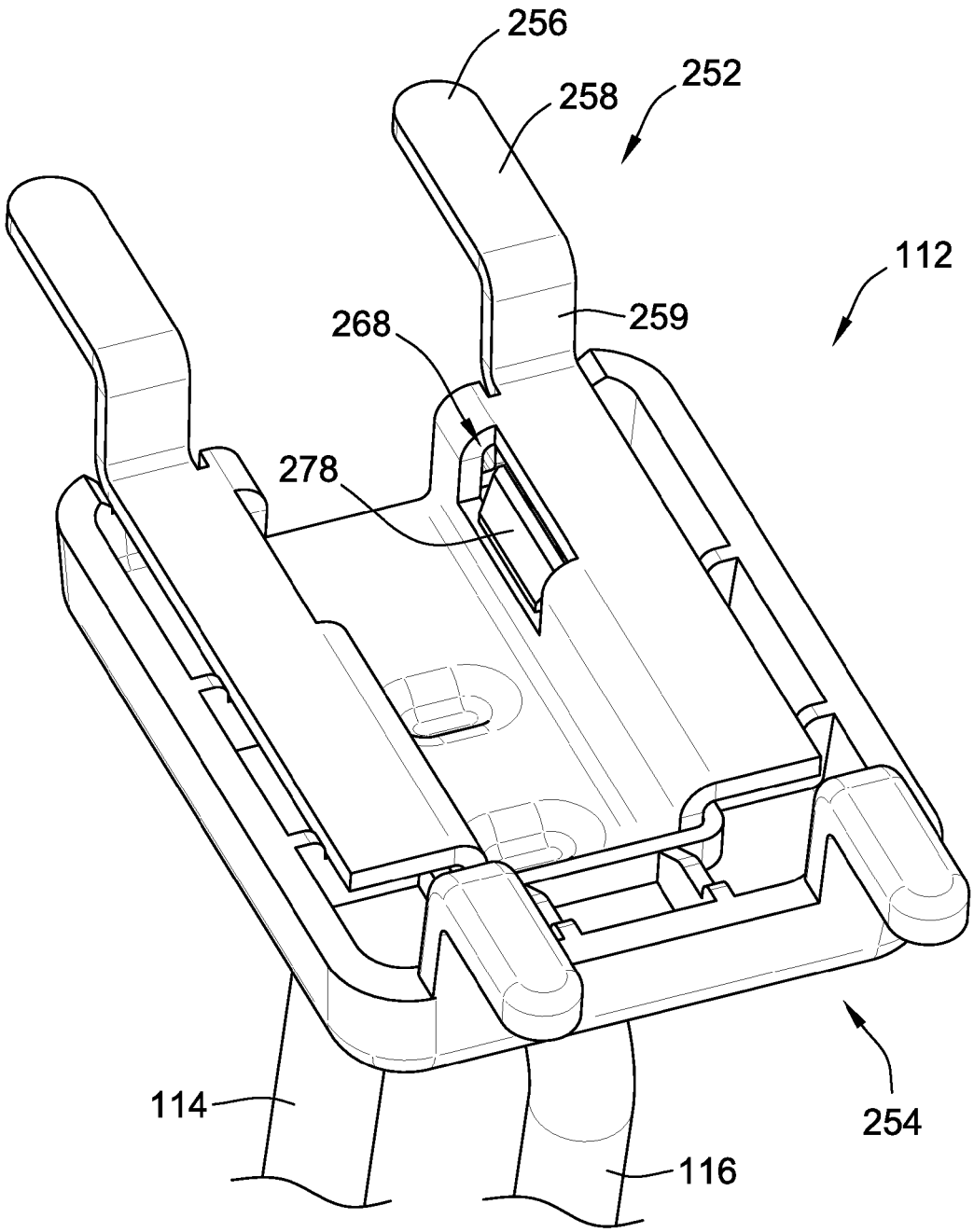
FIG. 15 is an illustration of the metal stamping of the display hook engaged with the protective cover of the display lock system of FIG. 1.

The leg portions 276 (with reference to FIG. 14) include a plurality of abutment surfaces 284 that rest against the outer face of the wing sections 263 of the metal stamping. The abutment surfaces 284 are formed in ribbed portions 285 of the U-shaped body 274 and particularly the leg portions 276. The wing sections 263 are thus sandwiched between the rib portions 285 of the U-shaped body 274 and the front surface of the pegboard 106 when fully assembled. This arrangement is illustrated in FIG. 12. With reference to FIGS. 13 and 14, the U-shaped body 274 defines a outer skirt 286 that has an abutment face 287 that will rest against the outer surface of the pegboard 106 and hide wing sections 263 when assembled. Thus the abutments surfaces 284 of the ribs 285 are laterally recessed relative to the abutment face 287 of the outer skirt 286.

Now that a general description of the display lock system 100 has been described, the operation and assembly thereof will be described.

The display hook 110 will first be mounted to the pegboard 106 by inserting the bent feet 256 of metal stamping 252 into apertures 108 of the pegboard 106. At this time, the top and bottom bars 114, 116 will be extending substantially vertically so that the back portions 258 of the metal stamping 252 can be inserted axially into apertures 108. The display hook 110 will then be rotated approximately 90° such that the bottom bars 114, 116 extend outward from the front face of the pegboard 106 such as illustrated in FIG. 1.

The protective cover 254 can then be attached to the pegboard 106 and the metal stamping 252. The feet of the protective cover 254 will then be inserted into corresponding apertures 108 of the pegboard 106. The protective cover 254 will then be rotated 90° and such that the latch catches 278 will engage the cavity 268 of the metal stamping 252. At this point, the display hook 110 is generally attached to the retail support such as the pegboard 106. Again, similar mounting would apply if a slatwall were used.

The display lock 130 can then be attached to the display hook 110. To attach the display lock 130, the user will first locate the lock body 132 of display lock 130 over the top bar 114 with the top bar 114 extending through the mounting channel 134 of the lock body such that the lock body 132 will straddle and be saddled over the top bar 114. Typically the location of the lock body 132 will be in a generally coined or flattened section of the top bar 114. The user can, if necessary, then insert the lock pins 202 and the ring members 216 into the corresponding channels of the lock body 132.

The lock bar 142 will then be positioned adjacent to the distal ends of the lock body 132 with the distal ends 148, 149 of the lock bar 142 sandwiching the lock body 132 thereinbetween. The user can then insert the attachment pin 136 through the corresponding apertures in the lock bar 142 and the lock body 132 to secure the display lock 130 to top bar 142. As the attachment pin 136 is being inserted through the distal ends 148, 149 and the lock body 132, the attachment pin 136 will also extend through the aperture 138 in the coined region of the top bar 114. The threaded lock nut 164 can then be threaded on to the threaded end 162 of the attachment pin. A cap or cover can then be inserted into the lock nut 164.

While locating the lock bar 142 relative to the lock body 132, the lock bar 142 may be separated into its two separate components. This will allow distal end 149 to be located proximate the lock body 132 easily. The user can then attach the separate component 184 to the rest of the lock bar 142 and locate it proximate the opposite end of the lock body 132. This makes for ease of assembly particularly if the lock bar 142 and the lock body 132 are formed from non-flexible material such as rigid metal.

The user can use the key 210 to transition the lock bar 142 to the open state illustrated in FIG. 2 if necessary. The user can then load the bottom bar 116 with merchandise 102. After the bottom bar 116 is loaded with merchandise, the user can then transition the lock bar 142 to the closed state as illustrated in FIG. 1. This will secure the merchandise 102 on the display hook 110.

It is noted that the present display lock 130 has the key interface on a side of the display lock such that it does not need to be inserted into the display lock 130 from the bottom or the front of the display lock. This makes it much more useful and easier to insert the key into the display lock 130. This is particularly true if the display lock 130 is positioned between different pieces of merchandise or on a lower portion of the retail display.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail merchandise lock for securing merchandise on a merchandise display hook of a retail display, the retail merchandise lock comprising:

a lock body defining a mounting channel for receiving a bar of the merchandise display hook therethrough;

a lock bar rotatable coupled to the lock body for rotation about a lock bar axis, the lock bar defining a lock bar aperture configured to receive a second bar of the merchandise display hook therethrough in a direction that is substantially perpendicular to the lock bar axis;

a lock arrangement acting between the lock bar and the lock body, the lock arrangement having a locked state in which the lock bar is prevented from rotating about the lock bar axis relative to the lock body, and an unlocked state in which the lock bar is allowed to rotate about the lock bar axis relative to the lock body; and wherein:

the lock arrangement includes a lock pin, the lock pin extending across a shear interface formed between the lock body and the lock bar, the lock pin engaging both the lock body and the lock bar in the locked state to prevent rotation of the lock bar relative to the lock body in the locked state;

the lock pin not extending across the shear interface and not engaging the lock bar in the unlocked state to allow rotation of the lock bar relative to the lock body in the unlocked state;

the lock pin slidable between the locked and unlocked states along a pin axis.

2. The retail merchandise lock of claim 1, further comprising an attachment pin extending through the mounting channel for securing the lock body to the bar, the attachment pin being spaced away from a bottom of the mounting channel, the attachment pin and mounting channel configured such that the attachment pin can pass through an aperture formed through the bar of the merchandise display hook.

3. The retail merchandise lock of claim 1, further including a spring member biasing the lock pin toward the locked state.

4. The retail merchandise lock of claim 1, wherein the lock pin is slidably carried in a lock pin channel formed in the lock body, the lock bar including a first pin pocket, the lock pin extending into the first pin pocket in the locked state and being removed from the first pin pocket in the unlocked state, the lock pin engaging the portion of the lock bar forming the first pin pocket in the locked state to prevent rotation of the lock bar relative to the lock body.

5. The retail merchandise lock of claim 1, wherein the lock bar includes a key slot arranged to receive a key therein in a direction extending generally parallel to the pin axis; the key slot aligned with the lock pin providing access to the pin for axially engaging and biasing the pin to the unlocked state along the pin axis.

6. The retail merchandise lock of claim 5, wherein the key slot is non-circular such that rotation of the key within the key slot will cause rotation of the lock bar.

7. The retail merchandise lock of claim 1, wherein the lock bar is generally clevis shaped including a first leg portion and a second leg portion, the lock body being interposed between the first and second leg portions.

8. The retail merchandise lock of claim 1, wherein the lock pin is slidably carried in a lock pin channel formed in the lock body, the lock bar including a first pin pocket, the lock pin extending into the first pin pocket in the locked state and being removed from the first pin pocket in the unlocked state, the lock pin engaging the portion of the lock bar forming the first pin pocket in the locked state to prevent rotation of the lock bar relative to the lock body; the lock bar remaining in a fixed position relative to the lock body in the locked state;

the lock bar including a second pin pocket, the lock pin extending into the second pin pocket in a second locked state, different than the other locked state, to maintain the lock bar in the second locked state relative to the lock body.

9. The retail merchandise lock of claim 8, wherein the lock bar is in a second angular orientation relative to the lock body in the second locked state.

10. A retail merchandise lock for securing merchandise on a merchandise display hook of a retail display, the retail merchandise lock comprising:

a lock body defining a mounting channel for receiving a bar of the merchandise display hook therethrough;

a lock bar rotatably coupled to the lock body for rotation about a lock bar axis, the lock bar defining a lock bar aperture configured to receive a second bar of the merchandise display hook therethrough in a direction that is substantially perpendicular to the lock bar axis;

a lock arrangement acting between the lock bar and the lock body, the lock arrangement having a locked state in which the lock bar is prevented from rotating about the lock bar axis relative to the lock body, and an unlocked state in which the lock bar is allowed to rotate about the lock bar axis relative to the lock body;

wherein the lock bar is generally clevis shaped including a first leg portion and a second leg portion, the lock body being interposed between the first and second leg portions; and further comprising an attachment pin, the attachment pin extending through a first end of the first leg portion, through the lock body and into a second end of the second leg portion, the attachment pin being co-axial with the lock bar axis, the attachment pin maintaining the lock body in a sandwiched relationship between the first and second ends.

11. The retail merchandise lock of claim 10, wherein the attachment pin includes first and second end portions, the first end of the first leg portion includes a first abutment plate through which the attachment pin extends, the first abutment plate configured to prevent passage of the first end portion of the attachment pin therethrough, the second end of the second leg portion includes a second abutment plate through which the attachment pin extends, the second abutment plate configured to prevent passage of the second end portion therethrough, the first and second abutment plates being positioned between the first and second end portions.

12. The retail merchandise lock of claim 11, wherein the attachment pin is a bolt and the first end portion is a head of the bolt and the second end portion is a nut threaded onto an end of the bolt;

the first end of the first leg being detachable from the rest of the lock bar.

13. The retail merchandise lock of claim 11, further comprising a key for transitioning the lock arrangement between the locked and unlocked states, the first end of the first leg portion includes a key receiving aperture configured to receive the key for engagement of the key with the lock arrangement.

14. The retail merchandise lock of claim 13, wherein the key includes a central aperture, the central aperture receiving the first end portion of the attachment pin when the key is inserted into the key receiving aperture.

15. The retail merchandise lock of claim 10, wherein:

the lock arrangement includes a lock pin, the lock pin extending across a shear interface formed between the lock body and the lock bar, the lock pin engaging both the lock body and the lock bar in the locked state to prevent rotation of the lock bar relative to the lock body in the locked state;

the lock pin not extending across the shear interface and not engaging the lock body in the unlocked state to allow rotation of the lock bar relative to the lock body in the unlocked state;

the lock pin slidable between the locked and unlocked states along a pin axis.

16. The retail merchandise lock of claim 15, wherein the lock pin engages the attachment pin in the locked state.

17. The retail merchandise lock of claim 16, wherein the lock pin engages the first end portion in the locked state.

18. A retail display system comprising:

a merchandise display hook having first and second bars, the second bar configured to carry merchandise;

a lock body defining a mounting channel for receiving the first bar of the merchandise display hook therethrough;

a lock bar rotatably coupled to the lock body for rotation about a lock bar axis that is generally perpendicular to the first and second bars of the merchandise display hook, the lock bar and lock body forming a complete securing loop;

a lock arrangement acting between the lock bar and the lock body, the lock arrangement having a locked state in which the lock bar is fixed relative to the lock body in a closed state relative to the second bar where the lock bar inhibits removal of merchandise from the second bar, and an unlocked state in which the lock bar is allowed to rotate about the lock bar axis relative to the lock body to an open state where the lock bar does not inhibit removal of merchandise from the second bar; and wherein the first bar of the merchandise display hook includes a mounting aperture therethrough, further comprising an attachment pin, the attachment pin extending through the mounting channel of the lock body and the mounting aperture of the first bar of the merchandise display hook to secure the lock body and lock bar to the first bar of the merchandise display hook.

19. The retail display system of claim 18, wherein the attachment pin is co-axial with the lock bar axis.

20. The retail display system of claim 18, wherein the lock bar includes first and second leg portions that are spaced apart from one another along the lock bar axis, the first and second leg portions being coupled together by a bend, the second bar extending through a cavity formed between the first and second leg portions, the lock body and the bend when the lock bar is in the closed state, the second bar not passing through the cavity when the lock bar is in the open state.

21. A retail display system comprising:

a merchandise display hook having second bars, the second bar configured to carry merchandise;

a lock body defining a mounting channel for receiving the first bar of the merchandise display hook therethrough;

a lock bar rotatably coupled to the lock body for rotation about a lock bar axis that is generally perpendicular to the first and second bars of the merchandise display hook, the lock bar and lock body forming a complete securing loop;

a lock arrangement acting between the lock bar and the lock body, the lock arrangement having a locked state in which the lock bar is fixed relative to the lock body in a closed state relative to the second bar where the lock bar inhibits removal of merchandise from the second bar, and an unlocked state in which the lock bar is allowed to rotate about the lock bar axis relative to the lock body to an open state where the lock bar does not inhibit removal of merchandise from the second bar; and further comprising a support structure to which the merchandise display hook is attached;

the merchandise display hook further including a metal stamping including at least one bent foot operably engaging the support structure to secure the merchandise display hook to the support structure;

further comprising a protective cover extending over the metal stamping and including a bent foot operably engaging the support structure to secure the protective cover to the support structure, the protective cover operably engaging the metal stamping to secure the metal stamping to the support structure.

22. The retail display system of claim 21, wherein the protective cover includes a cover body that is generally U-shaped defining a channel between a pair of legs, when the protective cover is engaged with the metal stamping, the top and bottom bars are positioned between the pair of legs.

23. The retail display system of claim 22, wherein the metal stamping includes first and second wings that are positioned proximate a front face of the support structure when mounted thereto, a first wall extending outward from and connected to the first wing and a second wall extending outward from and connected to the second wing, an intermediate portion extending between and connecting the first and second walls, the intermediate portion being positioned between the pair of legs of the protective cover, a gap being formed between the intermediate portion and the front face of the support structure, the at least one bent foot of the metal stamping is connected to at least one of the first and second wings.

24. The retail display system of claim 23, wherein the first and second walls include catch recesses formed in outer surfaces thereof, the protective cover including an inward extending catch on each leg, the catches cooperating with the catch recesses to create the engagement between the protective cover and the metal stamping.

* * * * *